US006241593B1

(12) United States Patent
Chen et al.

(10) Patent No.: US 6,241,593 B1
(45) Date of Patent: Jun. 5, 2001

(54) CARRIER HEAD WITH PRESSURIZABLE BLADDER

(75) Inventors: Hung Chih Chen, San Jose; Steven M. Zuniga, Soquel, both of CA (US); Frank Bose, Hillsboro, OR (US)

(73) Assignee: Applied Materials, Inc., Santa C.ara, CA (US)

( * ) Notice: Subject to any disclaimer, the term of this patent is extended or adjusted under 35 U.S.C. 154(b) by 0 days.

(21) Appl. No.: 09/350,950

(22) Filed: Jul. 9, 1999

(51) Int. Cl.[7] ..... B24B 5/00; B24B 29/00

(52) U.S. Cl. ..... 451/288; 451/398

(58) Field of Search ..... 451/8, 289, 398, 451/9, 285, 286, 287, 288, 290, 385, 397, 388; 279/3; 340/680

(56) References Cited

U.S. PATENT DOCUMENTS

| | | | | |
|---|---|---|---|---|
| 4,918,869 | | 4/1990 | Kitta | 51/131.1 |
| 5,193,316 | | 3/1993 | Olmstead | 51/281 |
| 5,205,082 | | 4/1993 | Shendon et al. | 51/237 |
| 5,423,716 | | 6/1995 | Strasbaugh | 451/388 |
| 5,449,316 | | 9/1995 | Strasbaugh | 451/289 |
| 5,584,751 | * | 12/1996 | Kobayashi et al. | 451/288 |
| 5,624,299 | * | 4/1997 | Shendon | 451/288 |
| 5,643,053 | | 7/1997 | Shendon | 451/28 |
| 5,643,061 | * | 7/1997 | Jackson et al. | 451/288 |
| 5,759,918 | | 6/1998 | Hoshizaki et al. | 438/692 |
| 5,795,215 | * | 8/1998 | Guthrie et al. | 451/288 |
| 5,803,799 | * | 9/1998 | Volodarsky et al. | 451/288 |
| 5,851,140 | * | 12/1998 | Barns et al. | 451/288 |
| 5,879,220 | | 3/1999 | Hasegawa et al. | 451/288 |
| 5,957,751 | * | 9/1999 | Govzman et al. | 451/8 |
| 5,964,653 | * | 10/1999 | Perlov et al. | 451/288 |

FOREIGN PATENT DOCUMENTS

| | | |
|---|---|---|
| 0 841 123 A1 | 5/1998 | (EP) . |
| 2243263 | 9/1990 | (JP) . |
| WO 99/07516 | 2/1999 | (WO) . |

* cited by examiner

*Primary Examiner*—Derris H. Banks
(74) *Attorney, Agent, or Firm*—Fish & Richardson

(57) ABSTRACT

Configurations within the CMP carrier head to maintain a constant contact area through which a downward pressure can be applied and distributed to the substrate for ensuring the force pressing the substrate against the pad will remain steady for each application of pressure, and for repeated application of pressure over time.

27 Claims, 7 Drawing Sheets

CARRIER HEAD WITH PRESSURIZABLE BLADDER

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad has abrasive particles held in a containment media. The carrier head provides a controllable load, i.e., pressure, on the substrate to push it against the polishing pad. Some carrier heads include a flexible membrane that applies pressure to the substrate to load it against the polishing pad. Pressurization or evacuation of a chamber behind the flexible membrane controls the load on the substrate. A polishing slurry, including at least one chemically-reactive agent, and abrasive particles, if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

SUMMARY

In one aspect, the invention is directed to a carrier head. The carrier head has a base, a flexible membrane extending beneath the base to form a pressurizable chamber, a support structure positioned in the chamber, and a pressurizable bladder formed between the base and the flexible membrane to control a downward pressure on the support structure. A lower surface of the flexible membrane provides a mounting surface on which a substrate can be positioned, and a lower surface of the support structure movable to contact an upper surface of the flexible membrane. At least one of the bladder and support structure is configured to provide a substantially constant contact area between the support structure and the bladder.

Implementations of the invention may include one or more of the following features. The support structure may include an upwardly extending projection having a top surface that contacts a bottom surface of the bladder. The top surface of the projection may be sufficiently smaller than the bottom surface of the bladder that the bladder remains in contact with the entire top surface as the support structure moves vertically. The bladder may extend over the projection to form a convolution. The bladder may includes a thick section that undergoes substantially no deformation as the bladder is inflated to contact the support structure. The bladder may includes two sidewalls connected to the base that have convoluted, e.g., pleated portions. Grooves may be formed in at least one of a bottom surface of the thick section and a top surface the support structure to provide fluid communication through the pressurizable chamber. The thick portion may include an indentation, and the support structure may include a projection that fits into the indentation. The bladder may be joined to the flexible membrane. A bottom surface of the bladder may include a rigid ring to provide a constant contact area with the support structure.

In another aspect, the invention is directed to a carrier head for a chemical mechanical polishing apparatus. The carrier head has a base, a first pressurizable chamber located below the base, support structure located in the first pressurizable chamber, and a second pressurizable chamber to apply a downward pressure to the support structure. The first pressurizable chamber has a first chamber wall formed of a flexible membrane with a lower surface that provides a mounting surface for a substrate, and the support structure contacts an upper surface of the flexible membrane. The second pressurizable chamber has a second chamber wall configured to contact the support structure over a constant contact area.

Implementations of the invention may include one or more of the following features. A top surface of the support structure may be sufficiently smaller than a bottom surface of the second chamber wall that the second chamber wall remains in contact with the entire top surface as the support structure moves vertically. A lower surface of the second chamber wall may includes a thick section to contact the support structure that undergoes substantially no deformation as the second chamber is pressurized. The second chamber may have pleated sidewalls, and the second chamber wall may be formed of a rigid ring. The first chamber wall and the second chamber wall may be portions of a single flexible membrane.

In another aspect, the invention is directed to a carrier head for a chemical mechanical polishing apparatus. The carrier head has a base, a retaining ring coupled to the base, a flexible membrane extending beneath the base to form a pressurizable chamber, a support structure positioned in the chamber, and means for applying a substantially constant downward pressure to an upper surface of the support structure as the retaining ring wears. A lower surface of the flexible membrane provides a mounting surface on which a substrate can be positioned, and a lower surface of the support structure is movable to contact an upper surface of the flexible membrane.

Implementations of the invention may include one or more of the following features. The means for applying a substantially constant downward pressure may includes a convoluted membrane. The means for applying a substantially constant downward pressure may include a bladder with a means for providing a substantially constant contact area with the upper surface of the support structure. The means for providing a substantially constant contact area may include a thick section of the bladder that undergoes substantially no deformation as the bladder is pressurized, or a rigid section of the bladder that undergoes substantially no deformation as the bladder is pressurized.

Advantages of the invention may include one or more of the following features. The pressurizable bladder provides an auxiliary pressure control that can generate a stable load to the wafer. The pressure applied to the support structure is a linear function of the pressure in the chamber. This applied pressure does not change as the retaining ring wears.

Other advantages and features of the invention will be apparent from the following description, including the drawings and claims.

Like reference numbers are designated in the various drawings to indicate like elements. A primed reference number or a number followed by a letter suffix indicates that the marked element has a modified function, operation or structure from the like element presented in previous drawings. Minor differences between embodiments that do not relate to the present invention have not been designated with letter suffixes or primed reference numbers.

DETAILED DESCRIPTION

Figure 1:
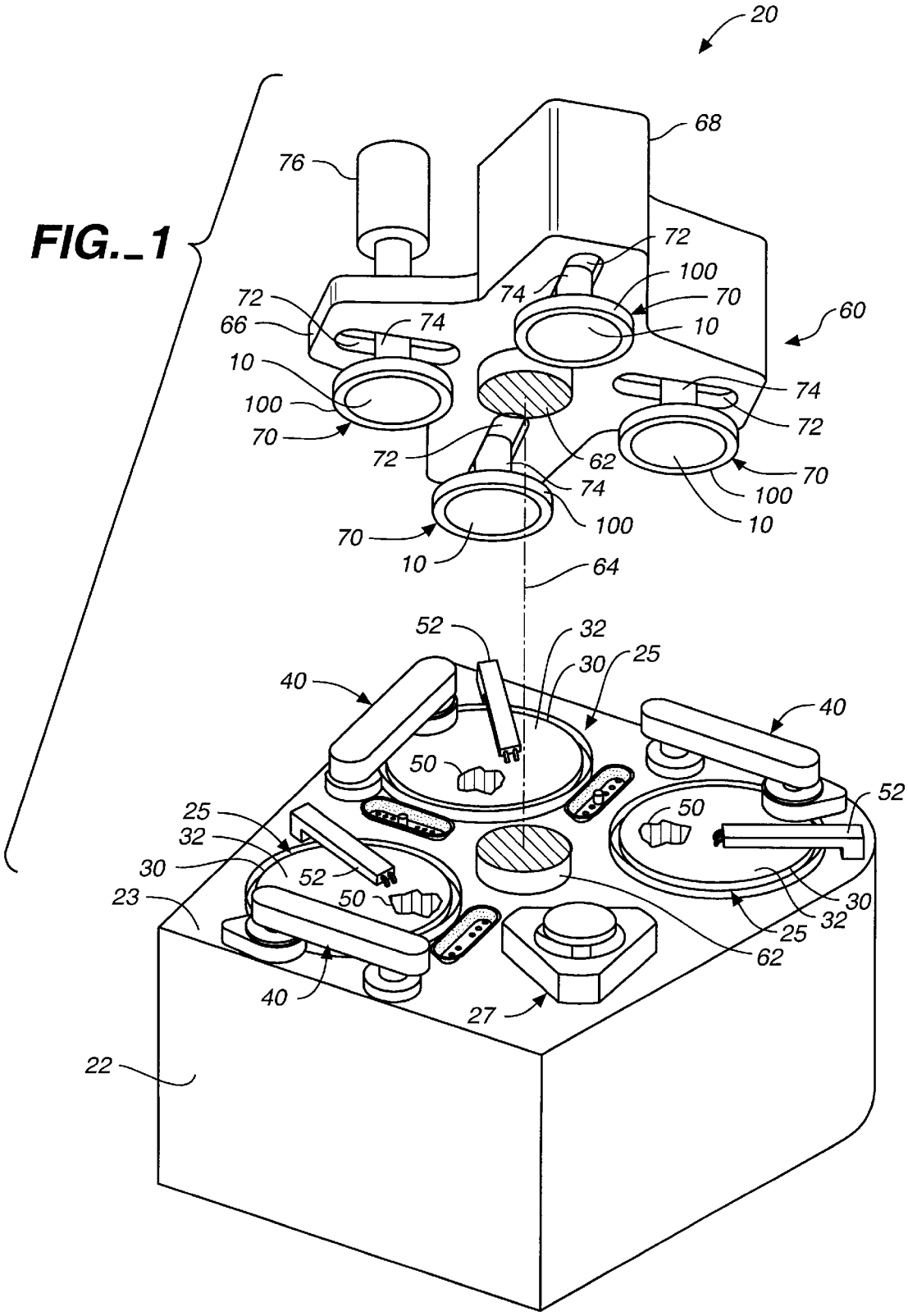
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a series of polishing stations 25 and a transfer station 27 for loading and unloading the substrates. Each polishing station 25 includes a rotatable platen 30 on which is placed a polishing surface such as a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 and polishing pad 32 may also be about twenty inches in diameter if substrate 10 is a six-inch (150 millimeter) diameter disk. For most polishing processes, a platen drive motor (not shown) rotates platen 30 at thirty to two-hundred revolutions per minute, although lower or higher rotational speeds may be used. Each polishing station 25 may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60 is supported by a center post 62 and rotated thereon about a carousel axis 64 by a carousel motor assembly (not shown). Multi-head carousel 60 includes four carrier head systems 70 mounted on a carousel support plate 66 at equal angular intervals about carousel axis 64. Three of the carrier head systems position substrates over the polishing stations. One of the carrier head systems receives a substrate from and delivers the substrate to the transfer station. The carousel motor may orbit carrier head systems 70, and the substrates attached thereto, about carousel axis 64 between the polishing stations and the transfer station.

Each carrier head system 70 includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of a carousel cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads are positioned at and above the three polishing stations. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
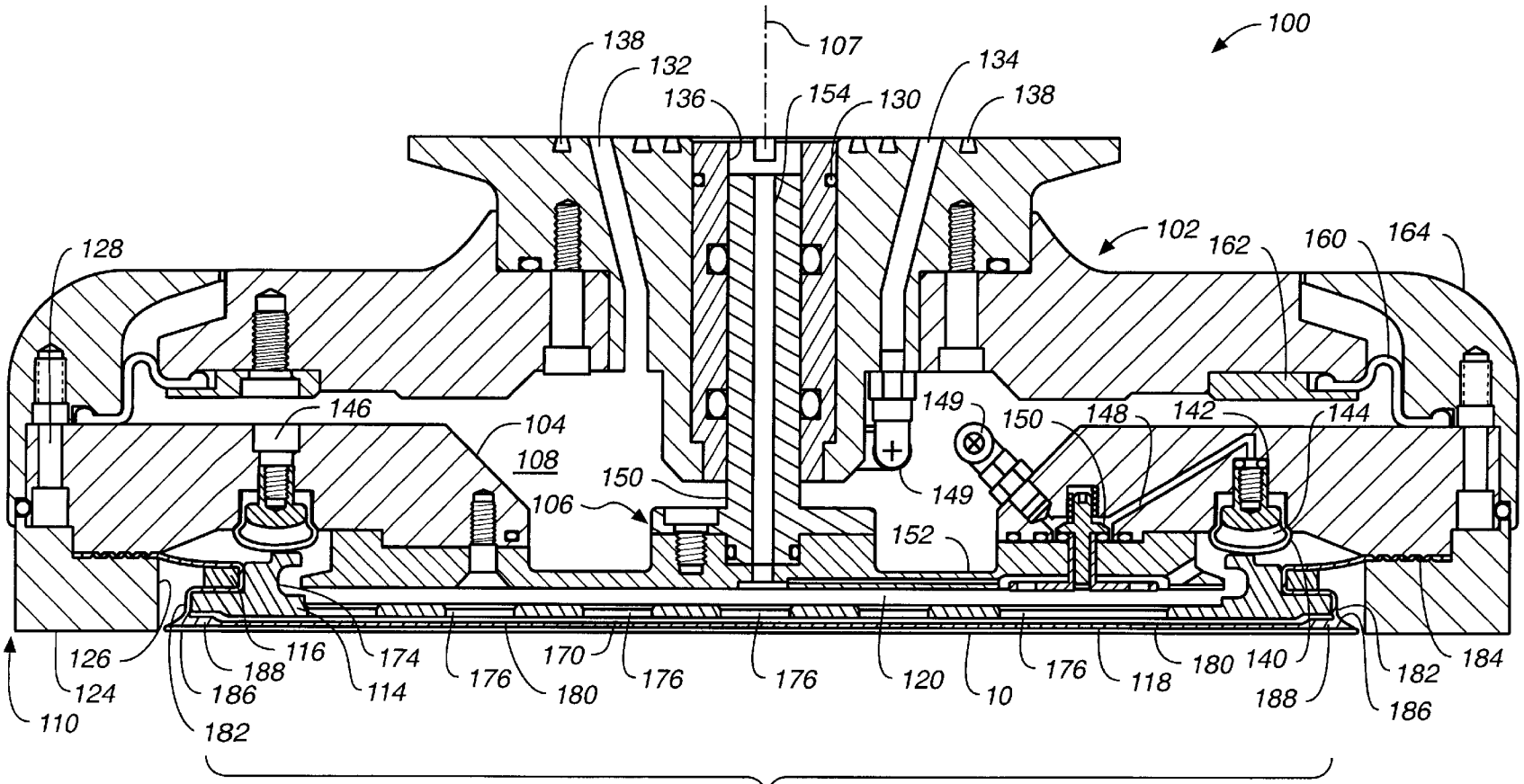
FIG. 2 is a schematic cross-sectional view of a carrier head according to one embodiment of the present invention.

Referring to FIG. 2, carrier head 100 includes a housing 102, a base 104, a gimbal mechanism 106, a loading chamber 108, a retaining ring 110, and a substrate backing assembly 112. A description of a similar carrier head may be found in U.S. application Ser. No. 08/861,260 by Zuniga, et al., filed May 21, 1997, entitled A CARRIER HEAD WITH A FLEXIBLE MEMBRANE FOR A CHEMICAL MECHANICAL POLISHING SYSTEM, and assigned to the assignee of the present invention, the entire disclosure of which is incorporated herein by reference.

Housing 102 can be connected to drive shaft 74 to rotate therewith during polishing about an axis of rotation 107 which is substantially perpendicular to the surface of the polishing pad during polishing. Housing 102 may be generally circular in shape to correspond to the circular configuration of the substrate to be polished. A vertical bore 130 may be formed through the housing, and two passages 132 and 134 may extend through the housing for pneumatic control of the carrier head. A cylindrical bearing 136 fits into bore 130. O-rings 138 may be used to form fluid-tight seals between the passages through the housing and corresponding passages in the drive shaft.

Base 104 is a generally rigid ring-shaped or disk-shaped body located beneath housing 102. An elastic and flexible membrane 140 may be attached to the lower surface of base 104 by a clamp ring 142 to define a bladder 144. Membrane 140 may be composed of chloropene, ethylene propylene rubber, silicone, or a fabric reinforced elastomer. Clamp ring 142 may be secured to base 104 by screws or bolts 146 (only one bolt shown on the left side of FIG. 2). A passage 148 may extend through the clamp ring and the base, and two fixtures 149 may provide attachment points to connect a flexible tube (not shown) between housing 102 and base 104 to fluidly couple passage 134 to bladder 144. A first pump (not shown) may be connected to bladder 144 to direct a fluid, e.g., a gas, such as air, into or out of the bladder. An actuatable valve 158 may be positioned in passage 148 to provide a substrate sensing ca lity, as described in U.S. Pat. application Ser. No. 08/862,350, filed May 23, 1997, assigned to the assignee of the present invention, the entirety of which is incorporated herein by reference.

Gimbal mechanism 106, which may be considered to be part of base 104, permits the base to pivot with respect to housing 102 so that the base may remain substantially parallel with the surface of the polishing pad. Gimbal mechanism 106 includes a gimbal rod 150 which fits into cylindrical bearing 136 and a flexure ring 152 which is secured to base 104. Gimbal rod 150 may slide vertically along bore 130 to provide vertical motion of base 104, but it prevents any lateral motion of base 104 with respect to housing 102. Gimbal rod 150 may include a first passage 154 that extends the length of the gimbal rod.

An inner edge of a generally ring-shaped rolling diaphragm 160 may be clamped to housing 102 by an inner clamp ring 162, and an outer clamp ring 164 may clamp an outer edge of rolling diaphragm 160 to base 104. Thus, rolling diaphragm 160 seals the space between housing 102 and base 104 to define loading chamber 108. A second pump (not shown) may be fluidly connected to loading chamber 108 by passage 132 to control the pressure in the loading chamber and the load applied to base 104.

Retaining ring 110 may be a generally annular ring secured at the outer edge of base 104, e.g., by bolts 128. When fluid is pumped into loading chamber 108 and base 104 is pushed downwardly, retaining ring 110 is also pushed downardly to apply a load to polishing pad 32. A bottom surface 124 of retaining ring 110 may be substantially flat, or it may have a plurality of channels to facilitate transport of slurry from outside the retaining ring to the substrate. An inner surface 126 of retaining ring 110 engages the substrate to prevent it from escaping from beneath the carrier head.

Substrate backing assembly 112 includes a support structure 114, a flexible member or membrane 118, and a spacer ring 116. Flexible membrane 118 is a generally circular sheet formed of a flexible and elastic material, such as chloroprene or ethylene propylene rubber, or silicone. A central portion 180 of the flexible membrane 118 extends below support structure 114 to provide a mounting surface to engage the substrate. A perimeter portion 182 of the flexible membrane extends in a serpentine path between support structure 114 and spacer ring 116 to be secured to the carrier head, e.g., to base 104 or retaining ring 110. The flexible membrane 118 may terminate in a rim portion 184 which is clamped between base 104 and retaining ring 110 to form a fluid-tight seal. The space between flexible membrane 118 and base 104 defines a pressurizable chamber 120. A pump (not shown) may be fluidly connected to chamber 120 via passage 154 to control the pressure in chamber 120 and thus the downward force of the mounting surface on the substrate. The vertical position of base 104 relative to polishing pad 32 is also controlled by loading chamber 108. In addition, chamber 120 may be evacuated to pull flexible membrane 118 upwardly and thereby vacuum-chuck the substrate to the carrier head. The flexible membrane 118 may also include a lip portion 186 and a thick portion 188 to improve the vacuum-chucking reliability, as described in U.S. patent application Ser. No. 09/149,806, filed Sep. 8, 1998, assigned to the assignee of the present invention, the entirety of which is incorporated herein by reference.

Support structure 114 is located inside chamber 120 to provide a rigid support for the substrate during substrate chucking, to limit the upward motion of the substrate and flexible membrane when chamber 120 is evacuated, and to maintain the desired shape of flexible membrane 118. Specifically, support structure 114 may be a generally rigid member having a disk-shaped plate portion 170 with a plurality of apertures 176 formed therethrough, and a generally annular flange portion 174 that extends upwardly from plate portion 170. Support structure 114 may be "free-floating", i.e., not secured to the rest of the carrier head, and may be held in place by the flexible membrane.

Spacer ring 116 is a generally annular member positioned between retaining ring 110 and support structure 114. Specifically, spacer ring 116 may be located above a portion of support structure 114 that extends radially outward beyond flange portion 174.

In operation, fluid is pumped into chamber 120 to control the downward pressure applied to the substrate by flexible membrane 118. When polishing is finished, chamber 108 is evacuated to lift base 104 and support structure 114 away from the polishing pad. In addition, since spacer ring 116 rests on support structure 114, it will also be lifted away from the polishing pad.

In addition, fluid may be injected into or excavated from bladder 144 during polishing. When the fluid is directed into the bladder, bladder 144 will expand downwardly, creating a downward pressure on support structure 114 and flexible membrane 118. The downward pressure on support structure 114 causes the bottom surface of the support structure to press against the top surface of the flexible membrane 118 to control the pressure on a localized area of the substrate, as discussed in U.S. application Ser. No. 08/907,810, filed Aug. 8, 1997, assigned to the assignee of the present invention, the entirety of which is incorporated herein by reference. In addition, after polishing, bladder 144 can be used to press the flexible membrane 118 against substrate 10 to create a fluid-tight seal and ensure vacuum-chucking of the substrate to the flexible membrane when chamber 120 is evacuated. If the pump evacuates bladder 144, bladder 144 will contract and relinquish contact with support structure 114.

A reoccurring problem in CMP is the unsteady force pressing the substrate against the pad. An unsteady force results in suboptimal polishing performance. In addition, if the force changes from substrate to substrate, the different auxiliary pressures can create different polishing results in the different substrates. Assuming the pressure within bladder 144 is held constant by the connected pump, the downward force applied by bladder 144 to support structure 114 is held constant if the contact area between the bladder and the support structure remains constant over time. In addition, if this contact area remains constant while the pressure in the bladder changes, the downward force on the support structure will be a linear function of the pressure in bladder 144. The goal of a constant contact area between the bladder and support structure can be accomplished by several configurations, such as those illustrated in FIGS. 3 through 6.

Figure 3:
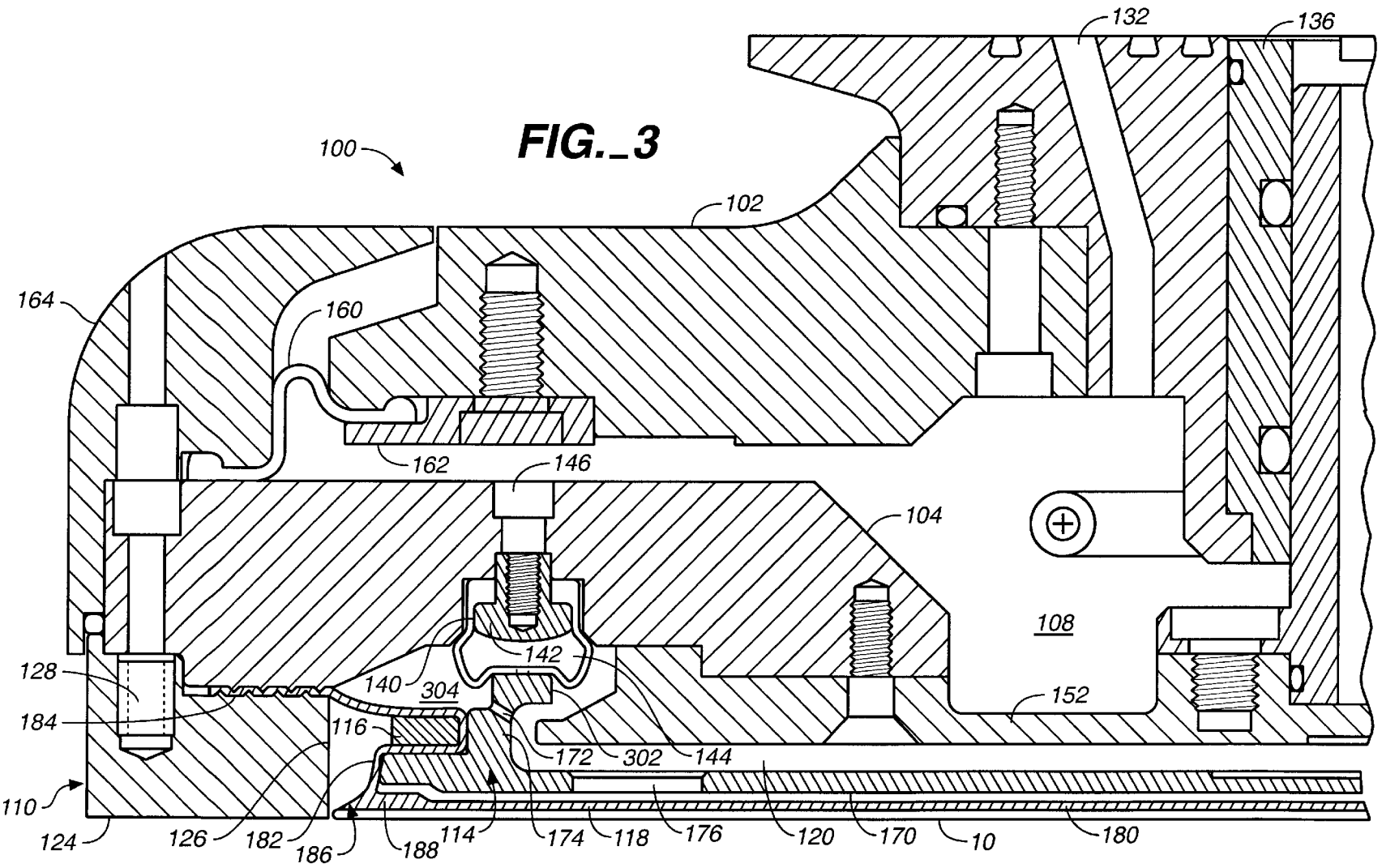
FIG. 3 is an enlarged view of the carrier head of FIG. 2 showing a pressurizable bladder having constant contact area with a support structure.

Referring to FIG. 3, bladder 144 can be used to press downwardly on a protrusion 302 at the top of flange portion 174. Protrusion 302 provides a substantially constant contact area between support structure 114 and bladder 144. Specifically, protrusion 302 is sufficiently smaller than bladder 144 that the bladder will contact the entire top surface of the protrusion, independent of the vertical position of the support structure. The dimensions of protrusion 302 are, in one implementation, about 50% to 60% of the radial width of the lower surface of membrane 140. Specifically, the protrusion may have a radial width of 0.22 to 0.23 inch, and a surface area of approximately 4.5 $in^2$. Slots or holes 172 are provided in support structure 114 to provide fluid communication between the volume 304 outboard of bladder 144 and the remainder of chamber 120.

Constant force on a per application basis is achieved by maintaining a substantially constant contact area between the bladder and the support structure, and by using a very compliant (low stiffness) bladder. Specifically, membrane 140 forms a convolution when the bladder is pressurized. This convolution acts as a rolling hinge that minimizes stretching of the membrane walls.

After multiple polishing operations, the bottom surface of the retaining ring is gradually worn away, resulting in a change of thickness of the retaining ring. This change in thickness brings base 104 and bladder 144 closer to polishing pad 32. Since support structure 114 rests on the substrate, which rests on the polishing pad, the spacing between bladder 144 and support structure 114 decreases as the retaining ring is worn away. However, since membrane 140 wraps around protrusion 302, it maintains a constant contact area, even as the support structure shifts vertically relative to the bladder. Because the contact area remains constant and membrane is very compliant, there is virtually no change in the relationship between the pressure in the bladder and the pressure applied to the support structure as the retaining ring is worn away.

Figure 4:
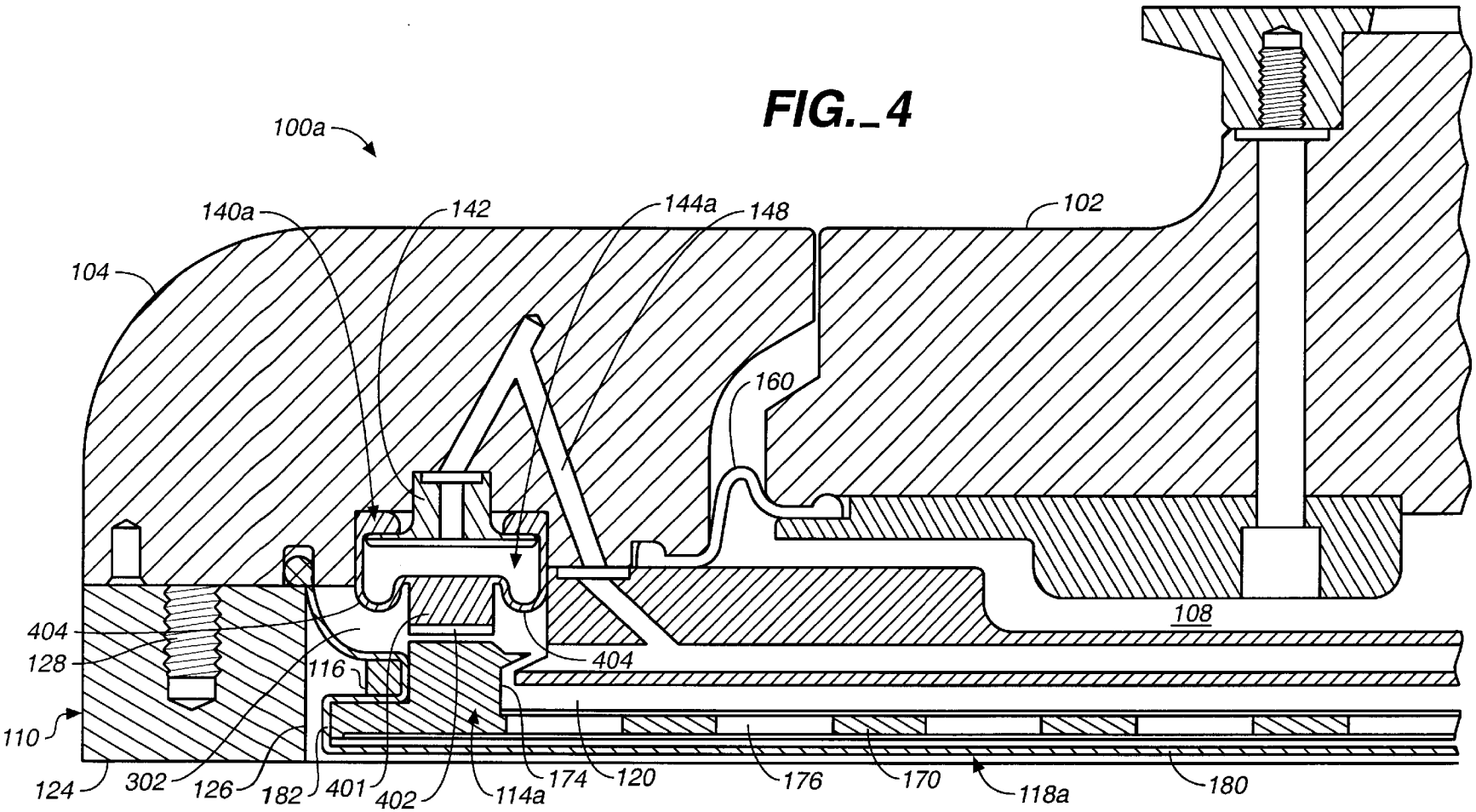
FIG. 4 is a schematic cross-sectional view of a carrier head in which a membrane that forms a bladder has a protrusion.

Referring to FIG. 4, in another embodiment, flexible membrane 140*a* may be aggregated at its bottom surface to form a protrusion 401 of constant dimensions. Even though flexible membrane 140*a* is made of flexible material, when a mass is formed such as shown in FIG. 4, protrusion 401 maintains its rigid shape of constant dimensions, i.e., it will not change as pressure builds up in bladder 144*a*. A plurality of slots 402 formed on the bottom of protrusion 401 allow air to pass between the bladder and the support structure. This arrangement allows volume 304 to remain in fluid communication with the rest of chamber 120. This reduces the likelihood of lateral movement of protrusion 401. Thus, protrusion 401 remains laterally stable and maintains a substantially constant contact area with support structure 114*a*. Alternatively, protrusion 401 can be an external structure added to the bottom surface of flexible membrane 140*a*, and it can be made of any suitable rigid materials. The contact area of protrusion 401 and support structure 114*a* will thus remain constant over time to ensure the downward pressure applied to the support structure 114*a* is stable. In addition, membrane 140*a* includes a built-in convolutions 404 to minimize stretching of the membrane walls. This ensures that the membrane is very compliant, so that the downward pressure remains substantially unchanged as the convolutions shift and the support structure moves relative to the base.

Figure 5:
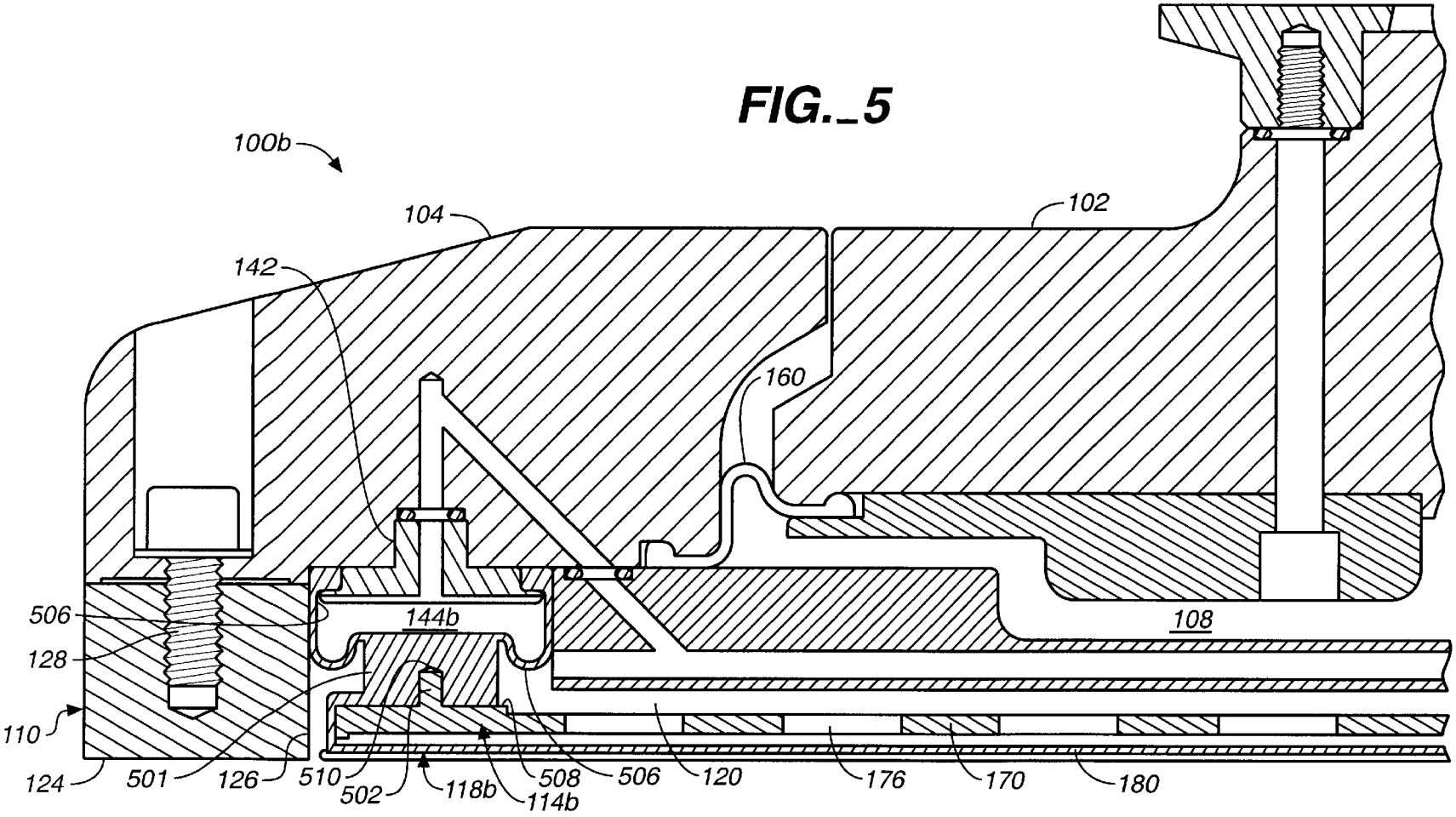
FIG. 5 is a schematic cross-sectional view of a carrier head in which a single membrane creates two pressurizable chambers.

In another embodiment shown in FIG. 5, the contact area between support structure 114*b* and bladder 144*b* is provided by a bump 501 of constant dimensions formed as an extension of flexible membrane 118*b*. In this embodiment, there is no separate membrane enclosing bladder 144*b*. Instead, the perimeter portion of membrane 118*b* extends around support structure 114*b* and upwardly to connect to the bladder. The bump 501 in membrane 118*c* is positioned on a top surface 508 of the support structure, and thin portions 506 extend upwardly from bump 501 to form the side walls of bladder 144*b*. An annular recess 510 is formed in a bottom surface of bump 501.

An annular protrusion 502 is formed on top surface 508 of support structure 114*b*. This protrusion 502 fits into recess 510 to guide support structure 114*b* into contact with bump 501. The radial width of protrusion 502 may be about 25% to 30% of the radial width of bump 501. Protrusion 502 prevents bump 501 from moving horizontally from side to side relative to support structure 114*b*.

Figure 6A:
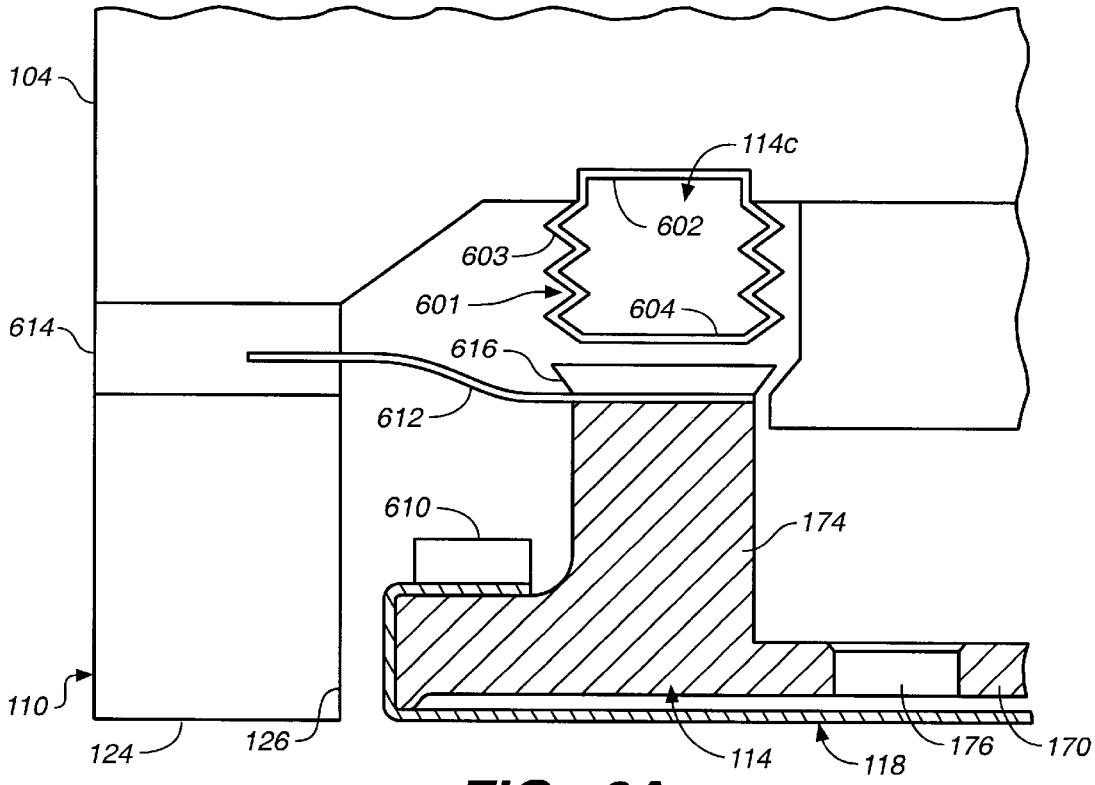
FIG. 6A is a schematic cross-sectional view of a carrier head in which the bladder tube has pleated sidewalls.

FIG. 6A shows another embodiment of the invention in which the walls of bladder 144*c* are formed of an elastic tube 601 with pleats 603. Tube 601 can be made of a variety of flexible materials, such as elastomer, e.g., rubber. Tube 601 functions much like a bellows, which expands and contracts by folding and unfolding the pleats. The pleats permit the bladder to expand downwardly without distorting the shape of the bottom surface of the bladder or stretching the tube. When bladder 144*c* is pressurized, the walls of tube 601 extend and the bottom surface of bladder 144*c* contacts support structure 114*c*. The elastic tube 601 is oriented vertically, and a rigid top 602 and a rigid bottom ring 604 are bonded to tube at the top and the bottom openings, respectively. In one implementation, the rings are made of steel. Rigid bottom ring 604 ensures a substantially constant contact area between support structure 114*c* and bladder 144*c*. This carrier head may include a clamp ring 610 to secure membrane 118 to support structure 114, and a separate flexure 612 to connect the support structure to the base. One end of flexure 612 may be held by an outer flexure clamp ring 614 that is captured between retaining ring 110 and base 104, and the other end of flexure 612 may be clamped between an inner flexure clamp ring 616 and flange 174 of support structure 114.

Figure 6B:
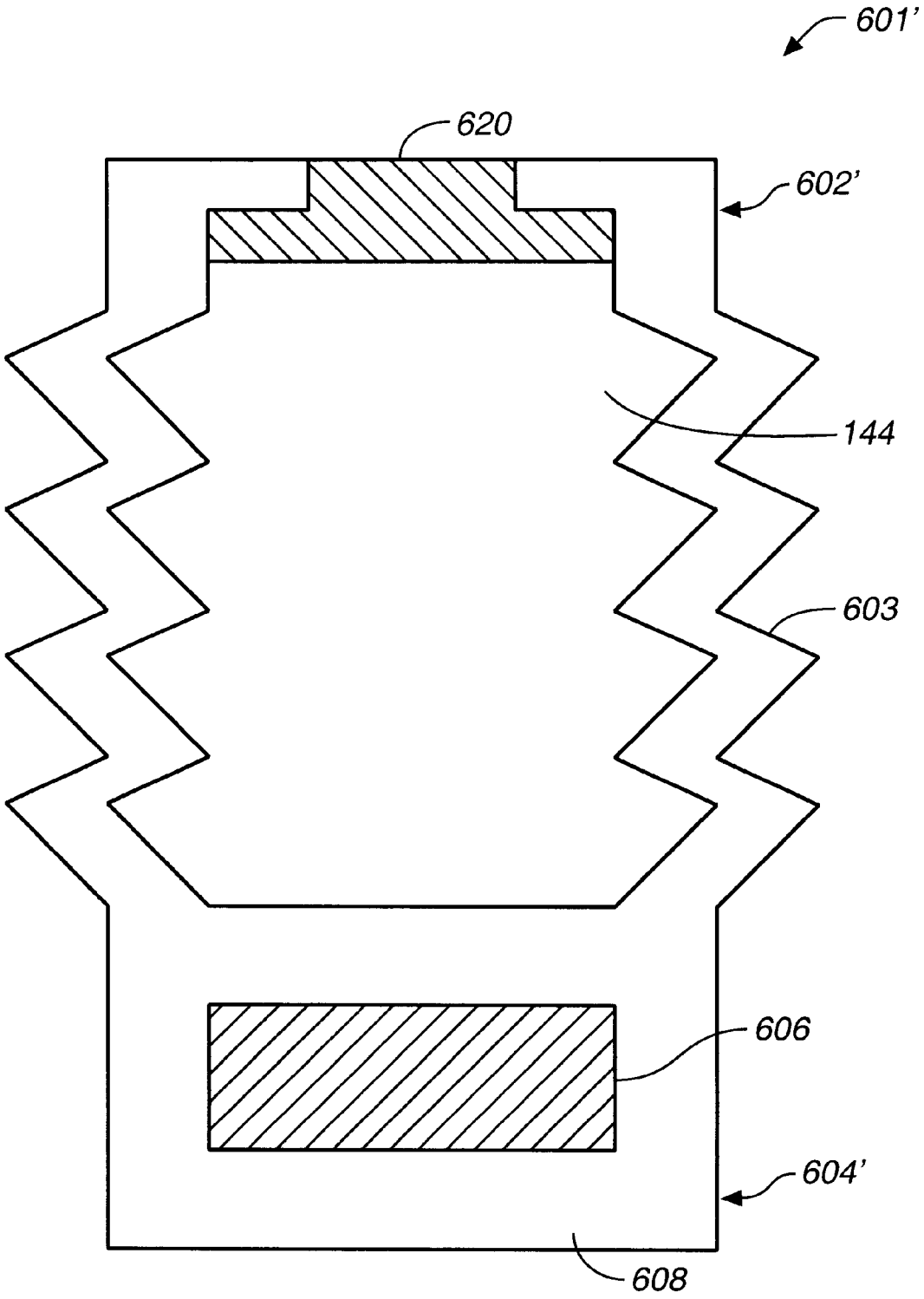
FIG. 6B is a enlarged schematic view of another embodiment of a bladder tube with pleated sidewalls.

FIG. 6B is a close-up view of an alternative implementation of tube 601' in which bottom ring 604' includes a reinforcement ring 606 embedded into the elastomeric material 608 of the bottom. Furthermore, top ring 602' includes a clamp ring 620 that secures the bladder assembly to the base.

The present invention has been described in terms of specific embodiments, which are illustrative of the invention and not to be construed as limiting. Other embodiments are within the scope of the following claims.

What is claimed is:

1. A carrier head, comprising:

a base;

a flexible membrane extending beneath the base to form a pressurizable chamber, a lower surface of the flexible membrane providing a mounting surface on which a substrate can be positioned;

a support structure positioned in the chamber, a lower surface of the support structure movable to contact an upper surface of the flexible membrane; and a pressurizable bladder formed between the base and the flexible membrane to control a downward pressure on the support structure, wherein at least one of the bladder and support structure is configured to provide a substantially constant contact area between the support structure and the bladder as a vertical position of the support structure relative to the base changes.

2. The carrier head of claim 1 wherein the support structure is configured to provide a substantially constant contact area between the support structure and the bladder.

3. The carrier head of claim 2, wherein the support structure includes an upwardly extending projection having a top surface that contacts a bottom surface of the bladder.

4. The carrier head of claim 3, wherein the top surface of the projection is sufficiently smaller than the bottom surface of the bladder that the bladder remains in contact with the entire top surface as the support structure moves vertically.

5. The carrier head of claim 4, wherein the bladder extends over the projection to form a convolution.

6. The carrier head of claim 1, wherein the bladder is configured to provide a substantially constant contact area between the support structure and the bladder.

7. The carrier head of claim 6, wherein the bladder includes a thick section that undergoes substantially no deformation as the bladder is inflated to contact the support structure.

8. The carrier head of claim 7, wherein the bladder further includes two sidewalls connected to the base.

9. The carrier head of claim 8, wherein the two sidewalls include a convoluted portion.

10. The carrier head of claim 7, wherein grooves are formed in at least one of a bottom surface of the thick section and a top surface the support structure to provide fluid communication through the pressurizable chamber.

11. The carrier head of claim 7, wherein the thick portion includes an indentation and the support structure includes a projection that fits into the indentation.

12. The carrier head of claim 11, wherein the indentation and projection are annular.

13. The carrier head of claim 6, wherein the bladder includes pleats forming the sides of the bladder.

14. The carrier head of claim 13, wherein a bottom surface of the bladder includes a rigid ring to provide a constant contact area with the support structure.

15. The carrier head of claim 1, wherein the bladder is joined to the flexible membrane.

16. The carrier head of claim 1, wherein a second flexible membrane extends below the base to form the pressurizable bladder.

17. A carrier head for a chemical mechanical polishing apparatus, comprising:

a base;

a first pressurizable chamber located below the base, the first pressurizable chamber having a first chamber wall formed of a flexible membrane with a lower surface that provides a mounting surface for a substrate;

a support structure located in the first pressurizable chamber to contact an upper surface of the flexible membrane; and a second pressurizable chamber to apply a downward pressure to the support structure, the second pressurizable chamber having a second chamber wall configured to contact the support structure over a constant contact area as a vertical position of the support structure relative to the base changes.

18. The carrier head of claim 17, wherein a top surface of the support structure is sufficiently smaller than a bottom surface of the second chamber wall that the second chamber wall remains in contact with the entire top surface as the support structure moves vertically.

19. The carrier head of claim 17, wherein a lower surface of the second chamber wall includes a thick section to contact the support structure that undergoes substantially no deformation as the second chamber is pressurized.

20. The carrier head of claim 17, wherein the second chamber has pleated sidewalls.

21. The carrier head of claim 20, wherein the second chamber wall is formed of a rigid ring.

22. The carrier head of claim 17, wherein the first chamber wall and the second chamber wall are portions of a single flexible membrane.

23. A carrier head for a chemical mechanical polishing apparatus, comprising:

a base;

a retaining ring coupled to the base;

a flexible membrane extending beneath the base to form a pressurizable chamber, a lower surface of the flexible membrane providing a mounting surface on which a substrate can be positioned;

a support structure positioned in the chamber, a lower surface of the support structure movable to contact an upper surface of the flexible membrane; and means for applying a substantially constant downward pressure to an upper surface of the support structure as the retaining ring wears and a vertical position of the support structure relative to the base changes.

24. The carrier head of claim 23, wherein the means includes a convoluted membrane to provide a high flexibility.

25. The carrier head of claim 23, wherein the means for applying a substantially constant downward pressure includes a bladder with a means for providing a substantially constant contact area with the upper surface of the support structure.

26. The carrier head of claim 25, wherein the means for providing a substantially constant contact area includes a thick section of the bladder that undergoes substantially no deformation as the bladder is pressurized.

27. The carrier head of claim 25, wherein the means for providing a substantially constant contact area includes a rigid section of the bladder that undergoes substantially no deformation as the bladder is pressurized.

* * * * *